United States Patent [19]

Schmid et al.

[11] 4,280,359

[45] Jul. 28, 1981

[54] ROTARY CAM DRIVE FOR IMPACT TOOL

[75] Inventors: Wolfgang Schmid, Plattenhardt; Karl Wanner, Echterdingen; Jörg Fälchle, Bempflinge; Manfred Bleicher; Frank Müller, both of Leinfelden, all of Fed. Rep. of Germany

[73] Assignee: Robert Bosch GmbH, Stuttgart, Fed. Rep. of Germany

[21] Appl. No.: 950,585

[22] Filed: Oct. 12, 1978

Related U.S. Application Data

[63] Continuation of Ser. No. 810,959, Jun. 29, 1977, abandoned, which is a continuation-in-part of Ser. No. 615,904, Sep. 23, 1975, abandoned.

[30] Foreign Application Priority Data

Oct. 16, 1974 [DE] Fed. Rep. of Germany ..... 2449191

[51] Int. Cl.[3] ..... B25D 11/10

[52] U.S. Cl. ..... 73/123; 73/118; 74/60

[58] Field of Search ..... 173/48, 123; 74/60, 74/57; 73/118, 122

[56] References Cited

U.S. PATENT DOCUMENTS

| | | | |
|---|---|---|---|
| Re. 23,803 | 3/1954 | Ruben | 74/60X |
| 1,901,981 | 3/1933 | Ousback | 173/118 X |
| 2,024,684 | 12/1935 | Erfass | 173/118 X |
| 2,232,984 | 2/1941 | Wahlmark | 74/60 X |
| 2,498,679 | 2/1950 | Hall | 74/60 |
| 2,824,455 | 2/1958 | Ristow et al. | 74/60 |
| 2,971,387 | 2/1961 | Spicacci | 74/60 |
| 3,139,038 | 6/1964 | Stewart | 74/60 X |
| 3,760,641 | 9/1973 | Espasa | 74/57 |
| 3,774,699 | 11/1973 | Schmuck | 173/48 |
| 3,828,863 | 8/1974 | Bleicher et al. | 173/48 |
| 3,964,323 | 6/1976 | Seibert | 74/60 |

FOREIGN PATENT DOCUMENTS

| | | | |
|---|---|---|---|
| 221667 | 6/1942 | Switzerland | 173/118 |

*Primary Examiner*—Werner H. Schroeder
*Assistant Examiner*—Andrew M. Falik
*Attorney, Agent, or Firm*—Michael J. Striker

[57] ABSTRACT

A hammer drill has a housing provided with a tool chuck in which a tool is to be mounted. A drive is provided which is capable of rotating and/or axially impacting the tool chuck. This drive includes a piston reciprocable in axial direction of the tool chuck, a drum rotating on a shaft extending parallel to the direction of reciprocation of the piston and provided with a circumferentially extending cam track, and a transmitting arrangement which travels in part in engagement with the cam track and which has another part connected with the piston to reciprocate the same.

21 Claims, 9 Drawing Figures

ROTARY CAM DRIVE FOR IMPACT TOOL

BACKGROUND OF THE INVENTION

This application is a continuation of application Ser. No. 810,959, filed June 29, 1977 which is now abandoned and was a continuation-in-part of copending application Ser. No. 615,904 filed Sept. 23, 1975, and now abandoned.

This invention relates generally to a powerdriven hand tool and more particularly to a hammer drill.

Hammer drills are well known in the art by this time. Generally speaking, they have a component that can be coupled with a tool, such as a drill bit, a chisle bit, or the like, and which component can be rotated, have axial blows or impacts exerted upon it so that the bit acts as a hammer, or the tool functions can be superimposed upon one another. Usually, an impactor is provided which is freely reciprocable in a tube and, when moving forwardly, impacts the rear end of the tool chuck or of a component associated therewith. Also provided is a power-driven piston which reciprocates in the same guide tube but is somewhat spaced from the impact member or angle so that a cushion or compressed air can develop between the two which transmits the kinetic energy to the angle from the piston. The prior-art constructions use an electric motor which drives a crank drive from which in turn the reciprocatory motion of the piston is derived.

This type of hammer drill is generally quite satisfactory. However, there are further improvements which it is desirable to make. In particular, the conversion of the rotary movement of the output shaft of the electric motor into a translatory motion, i.e., the reciprocation of the piston requires a rather complicated construction when it is accomplished by means of the aforementioned crank drive. At least four shafts are required, some of which have their axes inclined relative to one another, usually at right angles, and this requires the use of bevel gears, i.e. of angle drive, which is relatively complicated. Also, the use of a crank drive necessitates relatively large dimensions for the tool because of the space that is required.

SUMMARY OF THE INVENTION

It is a general object of the present invention to overcome the disadvantages of the prior art.

More particularly, it is an object of the present invention to provide an improved power-driven hand tool of the type in question, wherein the aforementioned disadvantages are eliminated.

Still more particularly, it is an object of the present invention to provide such a power-driven hand tool, especially a hammer drill, having a very simple arrangement for connecting the rotary movement of the drive motor into a reciprocatory movement of the piston, which arrangement is also inexpensive to produce.

In keeping with these objects, and with others which will become apparent hereafter, one feature of the invention resides in a power-driven hand tool, particularly a hammer drill, which comprises a housing, a tool chuck on the housing and adapted to hold an elongated tool, and means for impacting the tool chuck in direction lengthwise of the tool. This means for impacting comprises a first member reciprocable in the aforementioned direction, a rotatable second member formed with a circumferentially complete cam track, and transmitting means guided by the cam track and operatively connected with the first member for transmitting reciprocatory motion therein in response to rotation of the second member.

The crank drive of the prior art is thus eliminated and as a result the conversion of the rotary movement of the drive motor into a translatory movement, i.e., a reciprocation of the piston, can be effected by means of only three shafts which extend in parallelism to the longitudinal axis of the tool, i.e., in parallelism to the direction of reciprocation of the piston. This assumes that the drive motor, particularly an electric motor, is so arranged that its axis of rotation, which is one of the three axes mentioned above, extends parallel to the direction of reciprocation of the piston. This provides for a very simple and inexpensive construction and moreover permits a very precise control over the movements performed by the impact components of the device, thus assuring that the tool will operate relatively quietly and relatively free of vibrations, and will therefore cause a minimum of discomfort to the operator holding the tool.

It is particularly advantageous if the cam track is in form of a cam groove which is formed in the periphery of a driven drum, particularly a drum which rotates about an axis extending parallel to the reciprocation of the piston. According to one embodiment, one flank bounding the groove may form and act as a wobble plate, and a ring may be freely turnably received in the groove, being guided by this one flank and having a projection which transmits motion to the piston.

According to another and very advantageous embodiment, the projection may be replaced by a flange which rotationally symmetrically surrounds an elongated rod-like element but is axially reciprocable in the same direction as the piston and which may be solid or hollow, the flange extending into the groove and being guided therein.

The fact that the present invention has been able to replace the crank drive (which is universally used in hammer drills) with a wobble-plate drive, is surprising for a variety of reasons.

Hammer drills are heavy-duty-machines which are subject to very high mechanical stresses and which must be able to deliver strong impacts on the workpiece. Because of this, the industry has always been firmly convinced that only the strong, positive-guidance action of a crank-drive would be able to withstand the demands made of such tools and that the rather high vibrations and operating noises resulting from the use of a crank drive, and the attendant mental and physical discomfort to the operator, would have to be accepted as a trade-off for proper mechanical operation of the tool.

One reason why it was felt that a wobble-plate drive could not be used in hammer drills is that a motion-transmitting finger cooperating with the wobble-plate must engage the hammering piston from laterally thereof, not from the rear as is conventional in crank drives. To afford such lateral access, the guide tube for the piston must be slotted and it was felt that this would unacceptably increase the difficulties encountered in guiding and sealing the piston. Also, the lateral engaging finger applies a tilting movement to the piston and it was felt that the resulting increased friction acting on the piston, especially in the event of inadequate lubrication, would make such a construction inoperable.

Another factor which was considered practically insoluble, is the difficulty of coupling the motion-transmitting finger with the piston in such a manner as to avoid impeding the required freedom of three types of movement, namely rotational movement in two planes as well as sliding movement. Moreover, the coupling must transmit force in alternating directions, but the surface pressure per unit surface area must not be excessively high to avoid damaging the piston.

The mounting of the wobble plate itself also presents difficulties, because the plate must be journalled in two relatively large-sized bearings. A simple bearing cannot be used because of the drag which would result due to the reversal of rotation of the bearing bolts of a single bearing.

Added to all these problems, as perceived by the industry, were the expected difficulties resulting from the vibrations and impact forces to which the journal structure of a wobble-plate drive is subjected in the operation of a hammer drill.

The resulting prejudice in the art was such that, to applicants' knowledge, a wobble-plate drive has never been seriously proposed for hammer drills.

All of these problems and prejudices have been overcome by the present invention, which provides a construction which is not only very compact but wherein many of the conventionally required components are eliminated and noise and vibrations are substantially reduced.

The novel features which are considered as characteristic for the invention are set forth in particular in the appended claims. The invention itself, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
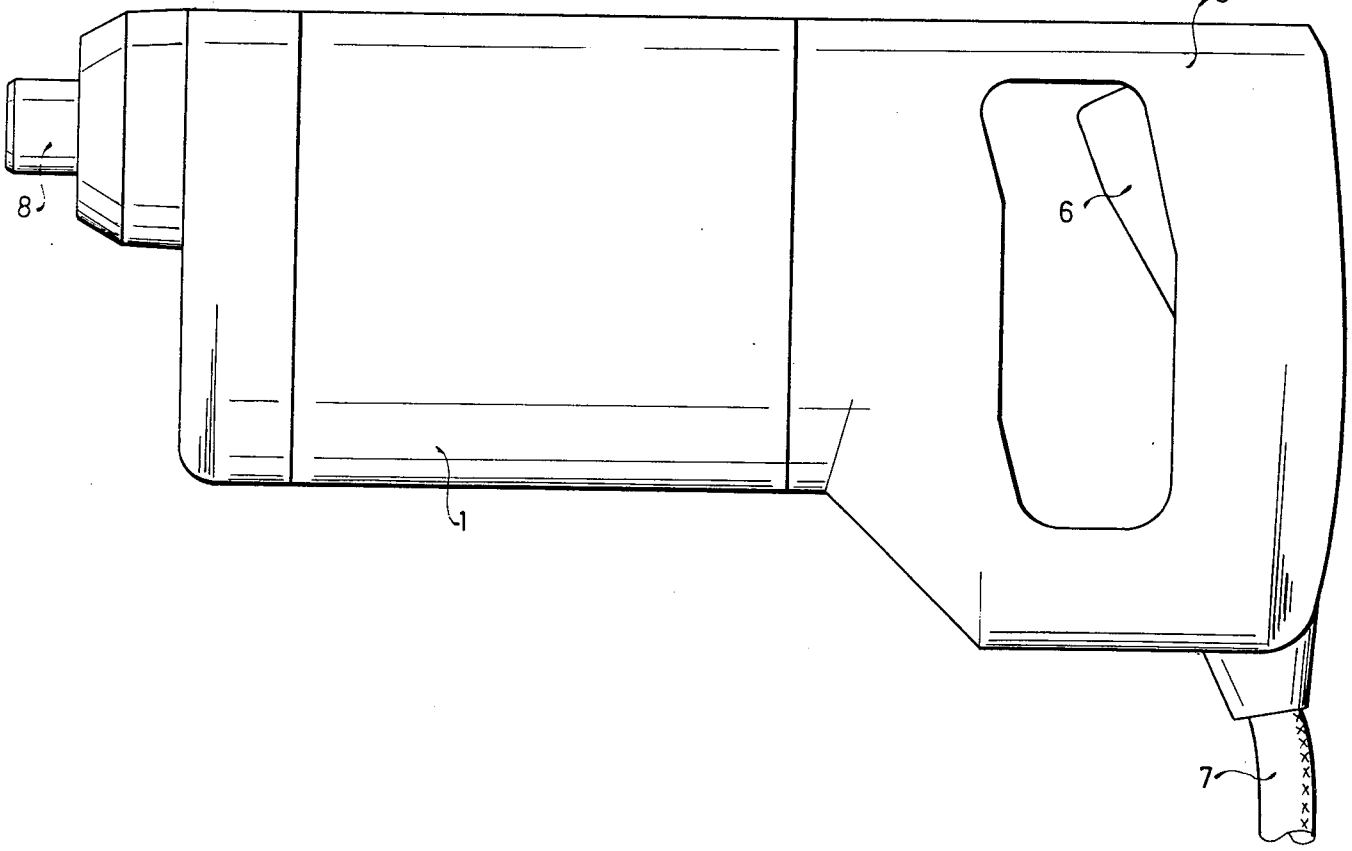
FIG. 1 is a somewhat diagrammatic side view illustrating a hammer drill embodying the invention.

Referring firstly to FIG. 1 it will be seen that this shows quite diagrammatically and for purposes of orientation a hammer drill in which the present invention can be embodied. The hammer drill has a housing 1 provided with a handgrip 5. A cable 7 extends from the exterior into the handgrip 5 and is there connected to a switch (not illustrated) which can be operated by a trigger 6, so that after power supplied via the cable 7 can be forwarded to an electric motor in the housing 1, to energize or de-energize the motor, in dependence upon whether the trigger 6 is operated or not. At the front end of the housing 1, the hammer drill is provided with a tool chuck 8 in which a tool (not shown) is to be removably mounted, for example a drill bit, a chisel bit or the like.

Figure 2:
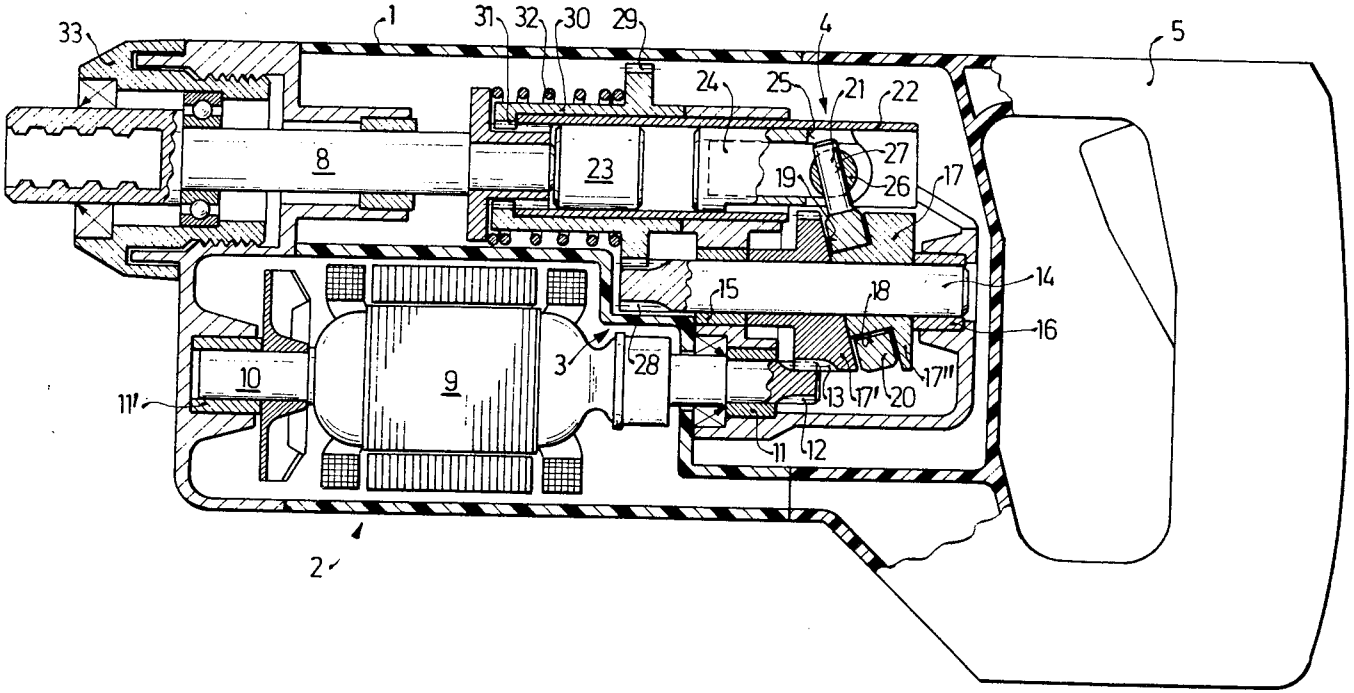
FIG. 2 is a fragmentary axial section through the hammer drill of FIG. 1, illustrating one embodiment of the invention.

FIG. 2 shows one embodiment of the present invention incorporated in a hammer drill of the type shown in FIG. 1. The electric motor is identified with reference numeral 2 and has a shaft 10 which extends parallel to the elongation of the housing 1 and which has its opposite end portions mounted for rotation in two journals 11 and 11', respectively. More specifically, it is the rotor 9 of the electric motor 2 that is provided with the shaft and is mounted for rotation. It is advantageous if the motor 2 is of the universal type.

That end portion of the shaft 10 which is journalled in the journal 11 is provided with a pinion 12 having teeth which mesh with annulus 13 of gear teeth that are provided on the circumference of a drum 17. The drum 17 is mounted on an intermediate shaft 14 which in turn is journalled for rotation at its opposite axial end portions by means of journals 15, and 16, respectively.

As FIG. 2 shows, the drum 17 is in this embodiment composed of two axially adjacent parts 17', 17'' which are suitable mounted on the shaft 14 for rotation with the same. A circumferentially extending and circumferentially complete cam groove 18 is formed in the periphery of the drum 17 and is located in a plane which is inclined with reference to the axis of rotation of the shaft 14. The right-hand end face of the portion 17' forms the left-hand flank 19 of the cam groove 18 and acts in the same manner as a well-known wobble plate. A ring member 20 is freely turnably accommodated in the groove 18, and it is for purposes of facilitating the mounting of the ring member 20 that the drum 17 is composed of the two parts 17' and 17''. The ring member 20 is provided with a radially projecting pin or projection 21 which serves to impart reciprocatory motion to the impact unit which is generally designated with reference numeral 4.

This impact unit is mounted in the interior of a stationary guide tube 22 and includes a freely axially reciprocable impactor or anvil 23 that is so dimensioned so as to have sealing contact with the inner circumference of the tube 22, and a similar sealingly received piston 24 which is also reciprocable in the guide tube 22. The wall of the guide tube 22 is provided with air ports which are opened and closed by the impactor 23 as the same reciprocates. The tool holder 8 has a portion **8*a* provided with a recess into which the shank of the respective tool is to be inserted, an intermediate portion 8*b* extending inwardly from the portion 8*a*, and a rear portion 8*c* extending into the forward end of the guide tube 22. The portion 8*c* carries a part having a radially projecting shoulder 8*d*. The part with the shoulder 8*d* may be suitably secured to the portion 8*c*** for example by shrink-fitting or the like.

As the drawing shows, in the illustrated embodiment that end portion of the piston 24 which faces away from the tool holder 8 is bifurcated, and the space between the two parts of the bifurcated end portion 25 is bridged by a pin or bolt 26 that is mounted with its opposite end portions in the respective parts of the end portion 25 and is freely turnable. The pin 26 is provided with a transverse bore 27 into which the projection 21 engages with play. Thus, the projection 21 can readily move in direction of its own axis in the bore 27.

That end of the shaft 14 which faces forwardly in the housing 1 is configurated as a pinion 28 whose teeth mesh with the teeth of an annulus 29 that is formed on a radially extending shoulder provided on a rotatable sleeve 30. The sleeve 30 is turnably mounted on the guide tube 22 and its forward end (the left-hand end in FIG. 2) is provided with an inwardly extending shoulder 31 formed with inner splines which engage in corresponding exterior splines on the part of the tool holder 8 which is provided with the flange 8*d*. The turnable sleeve 30 is surrounded over part of its length by a helical expansion spring 32, one end of which abuts against the shoulder formed with the annulus 29 of gear teeth and the other end of which abuts against the flange 8*d*.

The tool holder 8 can be shifted between two positions, namely the position illustrated in FIG. 2 and a further position in which it is shifted to the left in FIG. 2. For this purpose, a shifting and arresting mechanism 33 is provided, in form of a bayonet closure which permits the two aforementioned axial positions of the tool holder 8. When the tool holder 8*a* is in the position shown in FIG. 2, it is rotated as well as having axial impacts transmitted to its rear portion 8*c* via the impactor 23, when the motor 2 is energized. If the tool holder 8 is shifted leftwards in FIG. 2 to the second one of its positions, then the portion 8*c* moves far enough out of the guide tube 22 so that no cushion of compressed air can develop between the impactor 23 and the piston 24, so that the tool holder 8—while still being rotated—no longer receives impacts upon its rear portion 8*c*.

A detailed description of the operation of the drive in the embodiment of FIG. 2 is not believed to be necessary, as this is clearly self-explanatory from the drawing. It is evident that when the drum 17 is driven in rotation by the motor 2, the projection 21 will impart to the piston 24 a reciprocatory movement. When a tool holder 8 is in the position illustrated in FIG. 2, an air cushion will develop between the piston 24 and the impactor 23, i.e. a cushion of compressed air which acts as an energy-storing means and causes the impactor 23 to be hurled forwardly (to the left in FIG. 2) to impact upon the portion 8*c* of the tool holder 8. Upon such impact, the impactor 23 yields its energy to the tool holder 8 for transmission to a tool mounted in the tool holder 8, and then rebounds towards the right and towards the piston 24, for development of a new cushion of compressed air between them. The tool holder 8 is also rotated at the same time, via the pinion 28, the gear teeth 29 and the cooperating splines on the portion 8*d* and the shoulder 31.

This construction, wherein the flank 19 of the groove 18 operates as a wobble plate to transmit reciprocatory motion to the piston 24, is considerably less expensive than the crank drive known in hammer drills of the prior art, and at the same time eliminates the use for the otherwise necessary angle drives, i.e. bevel gears and the like. Moreover, the masses to be accelerated are smaller than in the prior art and because the device 4 is located directly above the shaft 14 and the associated components, the overall dimensions of a hammer drill constructed in this manner are considerably smaller than in the prior art and in particular the tool can be considerably shorter (from left to right in FIG. 2) than before.

Figure 3:
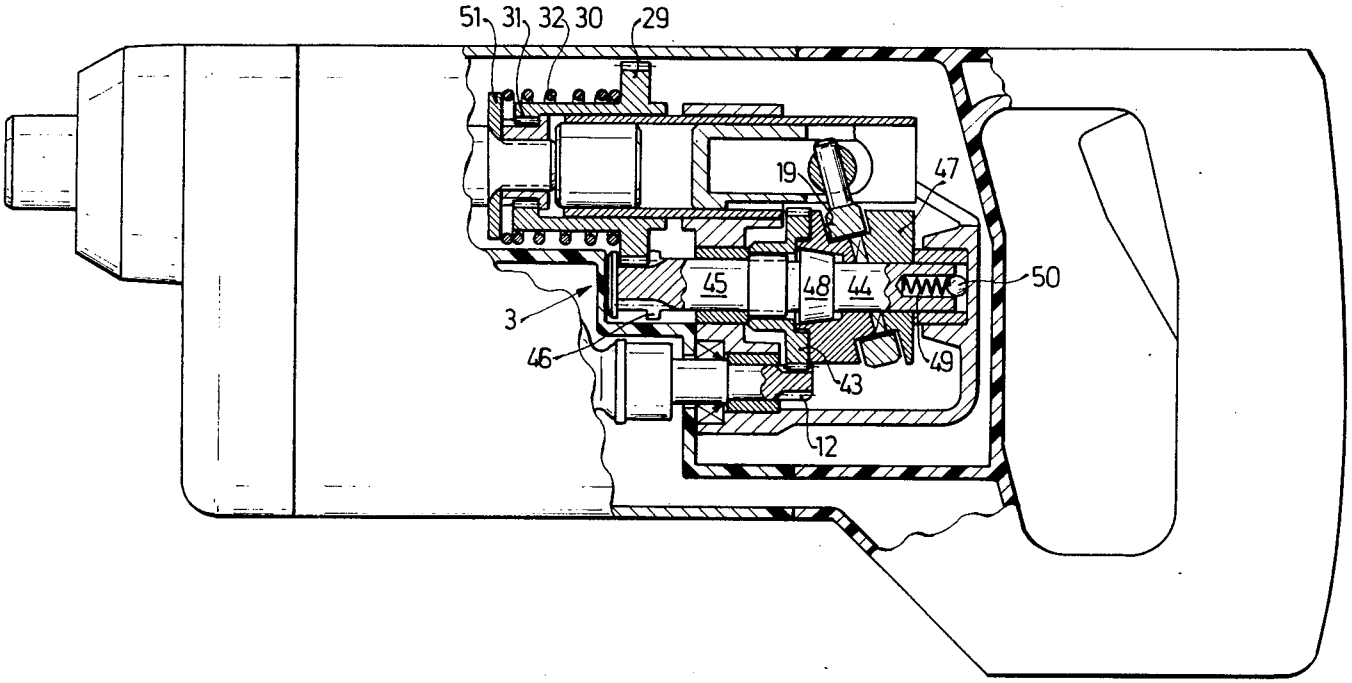
FIG. 3 is a view similar to FIG. 2 but illustrating a different embodiment of the invention.

A second embodiment of the invention is illustrated in FIG. 3. This embodiment is quite analogous to the one in FIG. 2 and like reference numerals have been used to identify like components where possible. The operation of the embodiment of FIG. 3 is also very much like the one in FIG. 2.

FIG. 3 differs from the embodiment in FIG. 2 in that the drum 17 has been replaced by a drum 47 which is again provided with the groove 18 bounded at one side by a flank 19 operating as a wobble plate. The drum 47, however, is turnably mounted on the shaft 44 which replaces the shaft 14 of FIG. 2, i.e. it can turn relative to the shaft 44. The shaft 44 in turn can be shifted axially, i.e. left to right in FIG. 3, and is permanently urged towards the left by a spring 49 received in an axial recess of the shaft 44 and having one end bearing upon the bottom of the recess and another end bearing upon a ball 50 which in turn is supported by a portion of the housing 1 or an associated stationary component.

A cone-type coupling 48 is provided to permit a selective coupling of the drum 47 with the shaft 44 for joint rotation. When this coupling 48 which, in the illustrated position of FIG. 3 is disengaged, is moved into engagement, it couples the shaft 44 and the drum 47 so that the latter now rotates with the shaft 44.

The shaft 44 is driven in rotation by the pinion 12 via a gear 43 that is axially shiftably mounted on the shaft 44 but rotates with the latter. The left-hand end portion of the shaft 44 is provided with a pinion 45 which meshes again with the annulus 29 of gear teeth provided on the flange of the rotary sleeve 30 but surrounds the guide tube 22 (compare FIG. 2). A shoulder 46 is provided on the pinion 45 and abuts the flange on which the annulus 29 of gear teeth is formed.

In the embodiment of FIG. 3 the tool holder 8 is normally only rotated, i.e. when the arrangement is in the position which it normally assumes and which is illustrated in FIG. 3, the tool holder 3 is rotated but has no impacts applied to it. If it is desired by an operator to utilize the impacting capability of the tool in FIG. 3, the operator presses forwardly on the handgrip, urging the tool held in the tool holder 8 against the workpiece, usually masonry rock or the like, and this causes the tool holder 8 to shift inwardly (to the right in FIG. 3) until the flange 8*d* engages the shoulder 31 of the rotary sleeve 30 and now shifts the rotary sleeve 30 towards the right. The flange of the sleeve 30 which is formed with the annulus 29 of the gear teeth is in permanent abutment with the flange 46 of the pinion 45, due to the biasing action exerted by the spring 49 upon the shaft 44, so that the right-ward displacement of the rotary sleeve 30 causes a similar displacement of the shaft 44 counter to the action of the spring 39. This results in an engagement of the cooperating components of the coupling 48, for example, a taper entry of the friction layer on the conical portion of the coupling that is provided on the shaft 44 into the conical recess of the drum 47, thus coupling the drum 47 for rotation with the shaft 44 and effecting reciprocation of the piston in the same manner as described with reference to the embodiment of FIG. 2. When the operator withdraws the tool from the workpiece, the spring 49 shifts the shaft 44 towards the left disengaging the coupling 48 and terminating the impacting operation, whereas the rotation of the tool holder 8 continues.

It should be understood that the coupling 48 need not be a friction coupling, but could also be a coupling of a different type, for example a coupling having cooperating claws or other projections on the shaft 44 and the drum 47, respectively.

Figure 4:
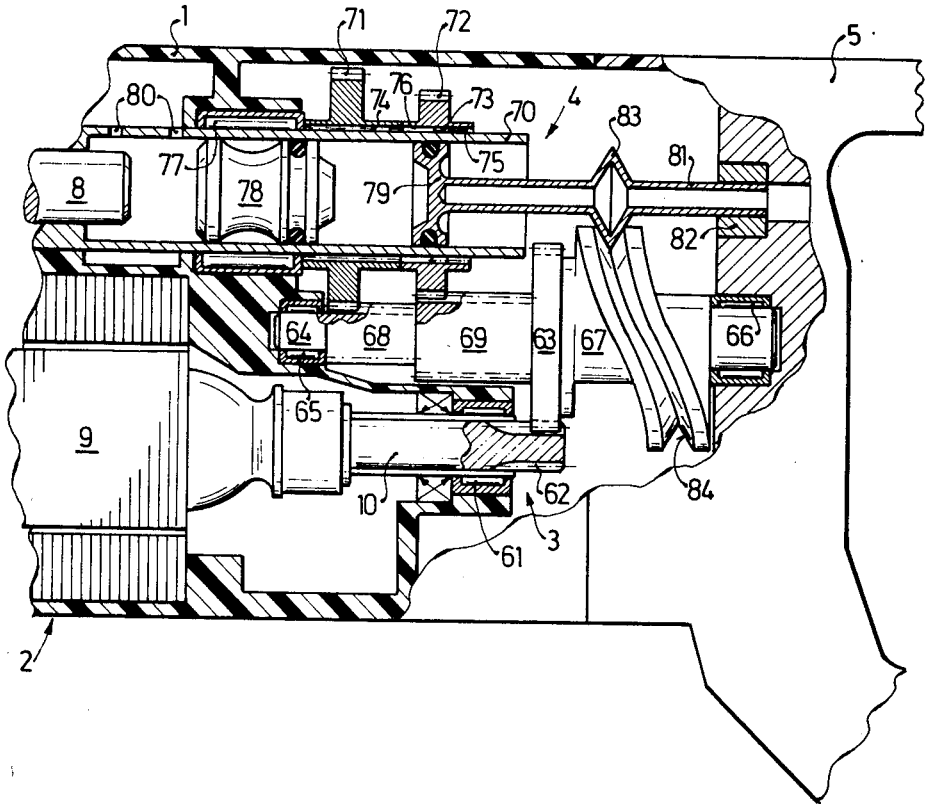
FIG. 4 is a view analogous to FIG. 2, illustrating a further embodiment of the invention.

FIG. 4 shows a third embodiment of the invention and in this Figure like reference numerals have again been used to identify like components as in the preceding embodiments.

In the embodiment of FIG. 4 the electric motor 2 is again mounted as in the preceding embodiments. Its rotor 9 has a shaft 10 the right-hand end portion of which is mounted for rotation in the roller bearing 61 and provided with a pinion 62. An intermediate shaft 64 is provided, journalled at its opposite end portions in roller bearings 65 and 66, respectively, and corresponding to the intermediate shaft 14 of FIG. 2. The shaft 64 is provided with a gear 63 which is mounted on it and which meshes with the teeth of the pinion 62, so that the shaft 64 is thus driven in rotation.

In addition, the shaft 64 has mounted on it a drum 67 which will be described subsequently, and is also provided with two circumferential annuli of gear teeth 68 and 69, respectively. A guide tube 70 is provided which extends parallel to the shaft 64 and has the same purpose as the guide tube 22 of FIG. 2. Mounted on the guide tube 70 are two axially adjacent gears 71 and 72 whose teeth mesh with the teeth of the annuli 68 and 69, respectively. This is a permanent engagement. The gears 71 and 72 are freely turnably mounted on the guide tube 70 and can be shifted axially of the latter by means of a non-illustrated shifting device which is well known in the art and forms no part of the invention.

The outer circumference of the guide tube 70 is provided with an annulus of engaging portions 73, for example axially extending splines, and the hub bores of the gears 71 and 72 are provided with similar annuli of engaging portions (for example axially extending splines) 74 and 75, respectively. Depending upon the axial position of the gears 71 and 72 the annuli 74 and 75 can be brought into engagement with the engaging portions of the annulus 73 so that the respective gears 71 and 72 are coupled with the guide tube 70 for rotation. In addition, the hub bore of the gear 71 is formed with a circumferentially extending groove 76 which is free of the engaging portions of the annulus 74 and which, when the gear 71 is located in appropriate position axially of the guide tube 70, permits a free turning of the gears 71, 72 on and relative to the guide tube 70. When the gears 71 and 72 are in this position, the guide tube 70 will not be rotated. It will be understood that the guide tube 70 is journalled for rotation in two bearings, for example roller bearings of which only the roller bearing 77 is illustrated.

The impact device 4 is again located in the interior of the guide tube 70. It includes an impactor 78 which is axially reciprocable in the guide tube 70 and receivingly engages the inner circumference of the latter, and a piston 79 which is also reciprocable in the guide tube 70 and sealingly engages the inner circumference thereof. The guide tube 70 is provided in its wall with several air ports 80 which are opened and closed by the impactor 78 depending upon the position thereof. The end portion 8*c* of the tool holder 8 extends into the front end of the guide tube 70 to be impacted by the impactor 78. The tool holder 8 of which only the portion 8*c* is illustrated, is connected with the guide tube 70 so it can shift axially relative thereof, but cannot rotate relative thereto (only therewith), the means for this purpose being not illustrated but similar to the ones in the preceding embodiments.

The piston 79 is provided with a concentrically projecting rod-like element 81, which in the illustrated embodiment is tubular, having an end portion remote from the piston 79 and guided slidably in a journal 82. Approximately midway intermediate the ends of the element 81 the latter is provided with a flange 83 which is configurated rotationally symmetrical with reference to the longitudinal axis of the element 81. The flange 83 serves to impart motion to the element 81 and hence to the piston 79. For this purpose it engages (as illustrated) in a circumferentially complete cam groove 84 formed in the outer periphery of the drum 67. In the illustrated embodiment the cross-section of the groove 84 is substantially V-shaped and is matched by the axial section of the flange 83 as shown. As illustrated the groove 84 is of sinusoidal configuration, but it should be understood that other configurations could be selected, for example in order to accommodate the sequence of the impacts to particular requirements.

Evidently, when the drum 67 rotates with the shaft 64, the element 81 will reciprocate and in turn reciprocate the piston 79. Since the piston 79 can rotate, being guided in the journal 82 with freedom of both reciprocation and rotation, the flange 83 will turn as it travels in the groove 84 and this reduces friction losses to a minimum. Of course, as in the preceding embodiments, a cushion of compressed air develops between the piston 71 and the impactor 78, in the manner known also from the prior art, to hurl the impactor 78 against the end portion 8*c* of the tool holder 8.

The piston 79 has a rather small mass in this embodiment, and both the element 81 and the flange 83 are hollow as illustrated. Because of this the mass forces are very low. The almost direct transmission of power from the pinion 62 to the piston 79, which eliminates many intermediate stages that are required in the prior art, permits the cumulative amount of play in the power train from the pinion 62 to the piston 79 to be rather small, a factor which is particularly important if the tool is to operate at high impact frequencies, because it permits the tool to operate relatively quietly and eliminates a large amount of wear.

The drum 67 is of relatively low weight and can even be made hollow if desired. Despite this, it has a large moment of inertia due to its relatively large outer diameter and thus in effect acts in the same manner as a flywheel, which has the advantage that the shaft 64 can store rotary energy which is available for accelerating the impactor 78 at the time of maximum compression of the air cushion between the impactor and the piston 79. This is, incidentally, also true of the preceding embodiment. It eliminates the high torque load on the motor which has been found objectionable in the prior-art hammer drills.

Figure 5:
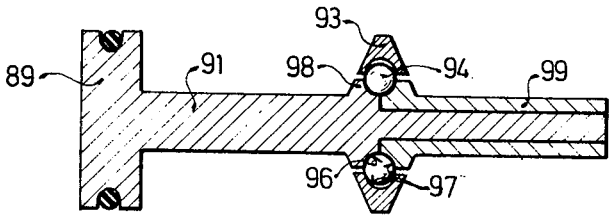
FIG. 5 is an axial section through an element according to a further embodiment of the invention, which element can be employed in the embodiment of FIG. 4.

A further embodiment of the invention is illustrated in FIG. 5. The elements of FIG. 5 can be used with the overall construction of FIG. 4, in lieu of the comparable elements shown in FIG. 4.

In FIG. 5, the piston 89 is comparable to and performs the same function as, the piston 79 of FIG. 4. It has a coaxially projecting rod-like element 91 which is shown as being of solid cross-section, but which could also be of hollow cross-section, just as the element 81 and/or the element 83 of FIG. 4 could be of solid cross-section. Substantially midway intermediate its ends the element 81 is provided with a flange 93 which is adapted to engage into the cam groove 84 (see FIG. 4) in the same manner as described with reference to the flange 83 in that Figure.

In FIG. 5 the flange 93 is turnable relative to the element 91. For this purpose, the flange 93 is annular, having a central bore provided with an inner circumferential bearing race 95 which is juxtaposed with an outer circumferential bearing race 96 formed on the element 91. It is advantageous if at the opposite axial ends these bearing races 95, 96 are bounded by relatively high (in radial direction) shoulders 97 which are capable of absorbing axial stress. The radial height of the shoulders 97 may approach—but of course not equal—the radius of the bearing balls 94 which are accommodated in the races 95, 96.

To permit a ready installation of the bearing balls 94 and of the flange 93, the element 91 is provided with circumferentially extending bead or shoulder 98, and axially adjacent thereto is formed of reduced cross-section. This portion of reduced cross-section has mounted on it—e.g. by press-fitting or shrink-fitting—a sleeve 99 that is formed with a second shoulder located axially adjacent to and in abutment with the shoulder 98. The race 96 is formed half in the shoulder 98, and half in the shoulder on the sleeve 99, i.e., it is axially centered on the plane of abutment of these shoulders. Evidently, this construction facilitates the assembly of the bearing balls 94 and of the flange 93. The bearing balls 94 may be accommodated in the races 95, 96 with or without use of a roller cage.

In the embodiment of FIG. 5 the flange 93 thus can rotate with reference to the element 91 and the piston 89. Hence, the piston 89 has transmitted to it only axially reciprocatory movements from the rotation of the drum 67 with the cam groove 84, but is not itself subjected to rotation. This has a two-fold advantage, in that the flange 93 can now freely rotate as it travels in the groove 84 and is not retarded by the friction of the piston with reference to the guide tube 70 as in the embodiment of FIG. 4, and it reduces the wear on the piston seal which is the part of the piston that engages the inner circumference of the guide tube 70 and which now must only undergo wear due to reciprocation and no longer wear due to rotation.

It will be appreciated that the flange 93 could also be mounted on the element 91 by means of a slide bearing, or that the element 91 could be mounted in the piston 89 so as to be rotatable relative to the latter.

Figure 6A:
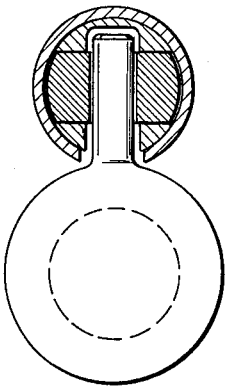
FIG. 6 is a fragmentary axial section, illustrating an additional embodiment.
Figure 6B:
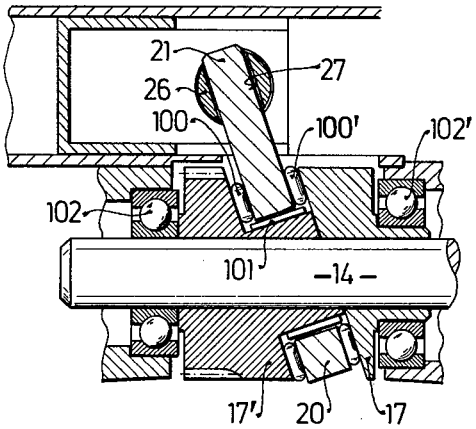

FIG. 6 shows an embodiment of the invention, the elements of which can be (and are currently preferred to be) used with the overall construction in FIG. 2, in lieu of the comparable elements shown in FIG. 2.

Like reference numerals have been used in FIG. 6 to designate elements identical to those in FIG. 2. In FIG. 6, however, the finger or projection 21 is journalled on the drum 17, 17' by means of a journal-bearing bushing 101 which is located in the cam groove 18 within the confines of ring 20, and further by means of two axial-thrust roller bearings 100, 100' which are located at opposite axial ends of the ring 20, between the same and the parts 17, 17' of the drum, respectively. The shaft 14 in this embodiment is journalled in two axially spaced anti-friction bearings 102, 102'.

This embodiment provides particularly quiet and low-vibration operation with a corresponding increase in the mental and physical well-being of an operator using it.

Figure 7:
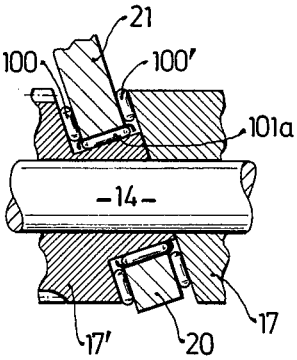
FIG. 7 is a section similar to FIG. 6 but of yet a further embodiment.

The embodiment of FIG. 7 is the same as the embodiment of FIG. 6, except that the bushing 101 is replaced with a more efficient radial roller bearing 101*a*.

Figure 8:
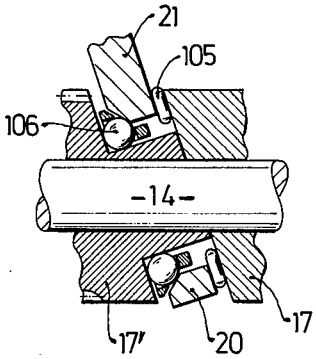
FIG. 8 is another section analogous to FIG. 6, but illustrates an additional embodiment.

In FIG. 8 an axial-thrust roller bearing 105 is used only at that axial end of ring 20 where the main stresses occur in operation. At its other axial side the ring 20 is journalled by an angular-contact ball bearing 106.

Figure 9:
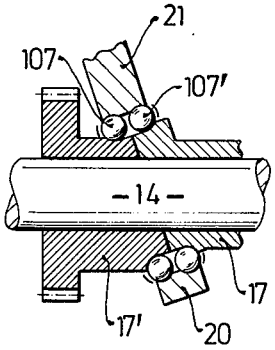
FIG. 9 is also a section similar to the one shown in FIG. 6 but showing still another embodiment of the invention.

FIG. 9 differs from FIG. 8 in that the ring 20 is journalled at both sides by means of respective angular-contact ball bearings 107, 107'. The shaft 14 may be journalled in bearing bushings or in anti-friction bearings in the embodiments of FIGS. 7, 8 and 9.

A hammer drill constructed according to the present invention is considerably simpler in its structural features than the ones known from the prior art, and it is therefore less expensive to produce and, not least, it is less subject to malfunction and repairs. It requires only three axially parallel shafts, for example in FIG. 2, the shafts 10, 14 and 30 (the sleeve 30 in effect acting as a shaft) and only six axially parallel bearings, but without thereby necessitating any deterioration in the reliability of operation which it offers.

While the invention has been illustrated and described as embodied in a hammer drill, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power-driven hammer drill, comprising a housing; a tool chuck on said housing and adapted to hold an elongated tool; means for impacting said tool chuck in direction lengthwise of the tool, including a member reciprocable in said direction; and drive means for said impacting means, comprising a rotatable shaft mounted for rotation about an axis paralleling said direction, a drum coaxially mounted on said shaft for rotation with the same and having a circumferential surface formed with a circumferentially complete cam track, and transmitting means guided by said cam track and operatively connected with said member for transmitting reciprocatory motion to the same in response to rotation of said drum with said shaft; means for supporting said rotatable shaft at two locations spaced from one another in an axial direction by a predetermined distance; and means for driving said rotatable shaft in rotation and including a driving shaft having a first toothed section, and a second toothed section provided on said drum and engageable with said first toothed section of said driving shaft, said second toothed section of said drum being located between said two locations within said distance so as not to extend axially beyond the latter.

2. An arrangement as defined in claim 1, wherein said supporting means includes two bearings each arranged at a respective one of said locations and supporting said rotatable shaft.

3. A hammer drill as defined in claim 1, wherein said cam track is a groove having an axial flank shaped to act as a wobble plate, said transmitting means comprising a ring freely turnably received in said groove and a projection extending substantially radially from said ring.

4. A hammer drill as defined in claim 3, said member having one end portion facing towards said tool chuck and another end portion facing away therefrom, said other end portion being formed with a bore extending transverse to said direction and said projection being slidably received in said bore.

5. A hammer drill as defined in claim 4, wherein said other end portion of said member is bifurcated and includes a transversely extending pin which is formed with said bore transverse to the elongation of said pin.

6. A hammer drill as defined in claim 1, wherein said cam track is a groove having a pair of axially spaced flanks shaped to act as a wobble plate; said transmitting means comprising a ring freely turnably received in said groove and a projection extending substantially radially from said ring, a bearing bushing within said ring and journalling the same in said groove, and a pair of axial-thrust roller bearings each interposed between said ring and one of said flanks.

7. A hammer drill as defined in claim 2, wherein said cam track is a groove having a pair of axially spaced flanks shaped to act as a wobble plate; said transmitting means comprising a ring freely turnably received in said groove and a projection extending substantially radially from said ring, a radial-thrust roller bearing within said ring and journalling the same in said groove, and a pair of axial-thrust roller bearings each interposed between said ring and one of said flanks.

8. A hammer drill as defined in claim 2, wherein said cam track is a groove having a pair of axially spaced flanks shaped to act as a wobble plate; said transmitting means comprising a ring freely turnably received in said groove and a projection extending substantially radially from said ring, an axial-thrust roller bearing interposed between said ring and one of said flanks, and an angular-contact anti-friction bearing interposed between said ring and the other of said flanks.

9. A hammer drill as defined in claim 1, wherein said cam track is a groove having a pair of axially spaced flanks shaped to act as a wobble plate; said transmitting means comprising a ring freely turnably received in said groove and a projection extending substantially radially from said ring, and a pair of angular-contact anti-friction bearings each supporting and journalling said ring with reference to one of said flanks.

10. A hammer drill as defined in claim 1, wherein said drive means comprises an electric motor.

11. A hammer drill as defined in claim 1, wherein said means for impacting comprise a guide tube coaxial with said tool chuck, said member being a piston which is sealingly received and reciprocable in said guide tube.

12. A hammer drill as defined in claim 1, wherein said transmitting means comprises a rotatable and axially reciprocable rod-like element and a flange surrounding said element rotationally symmetrical to the axis of rotation thereof, said flange engaging said cam track.

13. A hammer drill as defined in claim 12, wherein said cam track is a sinusoidal cam grove formed in the periphery of said drum.

14. A hammer drill as defined in claim 13, wherein said cam groove is bounded by two mutually inclined flanks and has a substantially V-shaped cross-section, said flange engaging at least one of said flanks.

15. A hammer drill as defined in claim 14, wherein said flange has an axial section which is also substantially V-shaped.

16. A power-driven hammer drill, comprising a housing; a tool chuck on said housing and adapted to hold an elongated tool; means for impacting said tool chuck in direction lengthwise of the tool including a guide tube coaxial with said tool chuck, and a piston which is slidingly received and reciprocable in said guide tube in said direction; and drive means for said impacting means, comprising a driven rotatable shaft mounted for rotation about an axis paralleling said direction, a drum coaxially mounted on said shaft freely turnably surrounding the same and having a circumferential surface formed with a circumferentially complete cam track, coupling means for coupling said drum for joint rotation with said shaft, and transmitting means guided by said cam track and operatively connected with said piston for transmitting reciprocatory motion to the same in response to rotation of said drum with said shaft, said coupling means comprising cooperating first and second coupling portions on said shaft and said drum, respectively, and said shaft being axially shiftable relative to said drum between two positions in which said first and second coupling portions are engaged and disengaged, respectively.

17. A hammer drill as defined in claim 16; and further comprising biasing means permanently biasing said shaft to that one of said positions in which said coupling portions are disengaged.

18. A hammer drill as defined in claim 16, wherein said coupling portions together form a cone-type coupling.

19. A power-driven hammer drill, comprising a housing; a tool chuck on said housing and adapted to hold an elongated tool; means for impacting said tool chuck in direction lengthwise of the tool, including a member reciprocable in said direction; and drive means for said impacting means, comprising a rotatable shaft mounted for rotation about an axis paralleling said direction, a drum coaxially mounted on said shaft for rotation with the same and having a circumferential surface formed with a circumferentially complete cam track, and transmitting means guided by said cam track and operatively connected with said member for transmitting reciprocatory motion to the same in response to rotation of said drum with said shaft, wherein said transmitting means comprises an axially reciprocable rod-like element, a flange surrounding said rod-like element and being rotationally symmetrical relative to the longitudinal axis thereof, and mounting means mounting said flange on said rod-like element for rotation relative to the same about said longitudinal axis, said flange and said rod-like element being formed with juxtaposed inner and outer circumferential recesses, and said mounting means comprising bearing balls in said recesses.

20. A hammer drill as defined in claim 19, wherein said races are bounded at the opposite axial ends theeof by respective radial shoulders each of which has a height approaching the radius of said bearing balls.

21. A hammer drill as defined in claim 19, wherein said rod-like element has a circumferentially extending first shoulder and axially adjacent thereto a portion of reduced cross-section, and a tubular portion surrounding said portion of reduced cross-section and provided with a second shoulder abutting said first shoulder, said outer circumferential race being formed in both of said shoulders and being centered on the plane of abutment of said shoulders.

* * * * *